United States Patent [19]

Deschler et al.

[11] 4,270,407

[45] Jun. 2, 1981

[54] CAMS FOR ACTUATING THE VALVES OF A RECIPROCATING MACHINE

[75] Inventors: Gerhard Deschler; Hans Gebhardt; Dieter Wittmann, all of Nuremberg, Fed. Rep. of Germany

[73] Assignee: Maschinenfabrik Augsburg-Nurnberg Aktiengesellschaft, Nuremberg, Fed. Rep. of Germany

[21] Appl. No.: 910,743

[22] Filed: May 30, 1978

[51] Int. Cl.[3] ..... F16H 53/06; F16H 25/16

[52] U.S. Cl. ..... 74/569; 74/55

[58] Field of Search ..... 74/569, 55, 567, 669

[56] References Cited

U.S. PATENT DOCUMENTS

| | | | |
|---|---|---|---|
| 3,034,363 | 5/1962 | Vogel | 74/55 |
| 3,303,833 | 2/1967 | Melling | 74/569 X |
| 3,413,964 | 12/1968 | Pask | 74/569 X |

*Primary Examiner*—Samuel Scott
*Assistant Examiner*—Wesley S. Ratliff, Jr.
*Attorney, Agent, or Firm*—Buell, Blenko, Ziesenheim & Beck

[57] ABSTRACT

The invention relates to a cam for actuating the valves of a reciprocating machine, the cam causing the valve to be opened via a flat-faced sliding-contact cam follower against the force of a closing spring.

2 Claims, 2 Drawing Figures

CAMS FOR ACTUATING THE VALVES OF A RECIPROCATING MACHINE

Engines and driven machines using a cyclic process need valves to implement the process which are normally actuated by rotating cams arranged on a shaft. In converting the rotating motion of the cam into a reciprocating motion at the valve, high accelerations are liable to occur which cause high stresses in the actuating elements resulting in heavy wear, in particular of parts performing large relative movements, such as cam and cam followers. This phenomenon of a higher rate of wear referred to the life of the machine of the services of cams and cam followers in sliding contact is enhanced by the trend towards the construction of more powerful engines and the adoption of higher speeds. The reasons are to be found mainly in the fact that an optimum load carrying hydrodynamic lubricant film fails to develop on the nose of the cam which is the critical region for lubrication because, as practical experience has shown, even cam profiles which are all designed dynamically will not warrant low-wear operation unless the hydrodynamic requirements for this are satisfied.

It is a well known fact which has been confirmed by tests that even between highly loaded sliding surfaces under conditions of liquid lubrication a lubricant film can form which, while not causing complete separation of the surfaces in sliding contact, will reduce the proportion of area in metallic contact by a proportion of the area where a hydrodynamic supporting film exists. This state of lubrication is in physics called mixed friction and its purpose is to achieve an as large as possible proportion of liquid load carrying film by the adoption of a selected kinematic motion pattern. Since the introduction of the theory of elasto-hydrodynamic lubrication it has been possible to predict film thicknesses which can be verified experimentally. This new theory is a variant of the classical theory of hydrodynamic lubrication developed by Osbore Reynolds in 1886 and takes into consideration the increase in lubricant viscosity under compressive loading and localized elastic deformation of the loaded contact surfaces.

The formula for the calculation of the minimum lubricant film was established by Dowson and Higginson (Paper by Fowle "The elasto-hydrodynamic theory of lubrication", published by Shell International Petroleum Co. Ltd., London) and is the result of a mathematical analysis of the elasto-hydrodynamic theory of lubrication. It reads:

$$H=1.6\times G^{0.6}\times U^{0.7}\times W^{-0.13} \quad \text{(I).}$$

where H, G, U and W are dimensionless groups of factors which are substituted for $$H=h_{min}/\rho,\ G=\alpha\times E',\ U=(\eta\times u)/(E'\times\rho),\ W=w/(E'\times\rho)$$

where:

$h_{min}$—die minimum thickness of the lubricant film $\rho$—the theoretical radius of curvature derived from $1/p=1/p_1+1/p_2$, where $p_1$ and $p_2$ are the radii of curvature of the two surfaces in contact, $\alpha$—the pressure coefficient of the lubricant viscosity from the expression $\eta_p=\eta\times e^{\alpha p}$ where $\eta_p$ is the viscosity at pressure p, E'—the reduced modulus of elasticity for the materials of the surfaces in sliding contact, $1/E'=\frac{1}{2}(1-\nu_1^2)/E_1+(1-\nu_2^1)/E_2$ where $E_1$ and $E_2$ are the modulus of elasticity and $\nu_1$ and $\nu_2$ the Poisson's ratios of the two surfaces, $\eta$—the lubricant viscosity at atmospheric pressure and ambient temperature, w—the load on unit width of the contact area u—sliding velocity of contact surfaces 1 and 2 according to the expression $u=\frac{1}{2}(u_1+u_2)$ In the equation cited the reduced modulus of elasticity E' is provided with only a very small exponent ($E^{0.03}$) and, furthermore, the materials used mechanical engineering differ only little from each other in their modulus of elasticity (E=80,000 to 210,000 N/mm$^2$). Also the pressure coefficient in the case of the lubricants used varies only within narrow limits and the influence of load changes on the lubricant film thickness (see group of factors W) can be ignored in view of the small exponent. Dowson and Higginson therefore stated the following simplified formula for calculating the minimum thickness $h_{min}$ of the lubricant film in which the terms $G^{0.6}$ and $W^{-0.13}$ in the above formula are replaced by constants to read:

$$h_{min}=5\times10^{-6}\sqrt{\eta\times u\times\rho} \quad \text{(II)}$$

As can be derived from the two formulae, the lubricant film thickness apart from viscosity$\eta$ is determined by the sliding velocity as well as the theoretical radius of curvature$\rho$ of the contact surface.

It is the object of the present invention to define cam geometry in the area of the cam nose, being the area of critical lubricant film formation, for a cam of the type described herein before in a manner that optimum conditions of lubrication are obtained.

According to the invention, this object is achieved in that the hydrodynamic rating index$\gamma$ is calculated from $r_N/(r_G+z)$ where $r_N$ is the cam radius of curvature, $r_G$ the base circle radius of the cam and z the respective cam lift and in that this rating index lies between the values of $0.15\leqq\gamma\leqq0.25$ or, if the shape of the cam permits, assumes values of $\gamma\leqq0.6$.

The calculation of the minimum lubricant film $h_{min}$ according to the relationship established by Dowson and Higginson serves as a criterion for this statement. For convenient deduction, the simplified formula (II) is considered and the invention explained in greater detail on the basis of a typical embodiment illustrated in the drawings in which.

Figure 1:
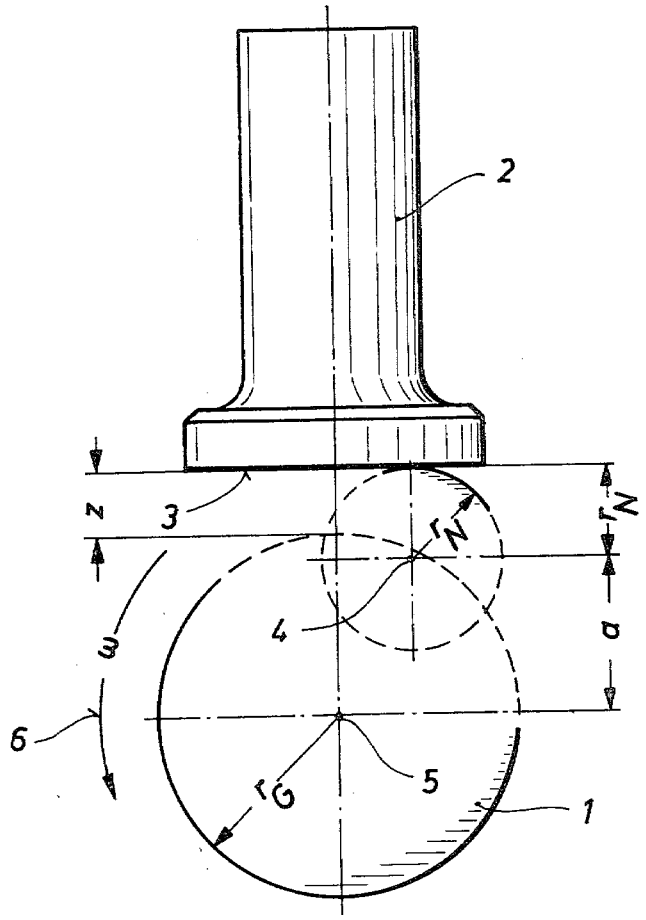
FIG. 1 is a purely schematic representation of a cam mechanism.

FIG. 1 shows a cam 1 schematically which is in the process of running against a sliding-contact tappet 2 with a flat face 3. The reference $r_G$ denotes the base circle radius and $r_N$ the radius of curvature of the cam 1. The distance of the centre 4 of the radius of curvature $r_N$ from the centre 5 of the base circle radius $r_G$ is given as "a", but the distance "a" is by no means the greatest distance between the two centres 4,5 from each other, but the distance measured in the direction of motion of the tappet 2 referred to the position of the cam 1. The same applies to the cam lift "z" which is measured at the point considered in each case and indicates the distance between the base circle radius $r_G$ and the face 3 of the tappet 2. The cam 1 rotates at an angular velocity $\omega$ in the direction of the arrow 6.

In accordance with the invention, the sliding velocity "$u_1$" at the cam 1 is first calculated which is obtained from $u_1 = r_N \times \omega$. The sliding velocity $u_2$ at tappet 2 is calculated from $u_2 = -a \times \omega$, this being strictly speaking at tappet centre.

Hence the sliding velocity "u" between cam 1 and tappet 2 is obtained as:

$$u = \tfrac{1}{2}(u_1 + u_2) = \tfrac{1}{2} \times [2r_N - (r_G + z)]\omega, \qquad \text{(IV)},$$

where, however, the distance $-a$ has been replaced by the equation valid for flat-face tappets $-a = r_N - (r_G + z)$ substituted in equation II.

If then the theoretical radius of curvature is also replaced by the radius of curvature of the cam $r_N$, then the minimum thickness of the lubricant film is obtained by $$h_{min} = \text{const.}\,(r_G + z) \times \sqrt{2\left(\frac{r_N}{r_G + z}\right)^2 - \left(\frac{r_N}{r_G + z}\right)} \qquad \text{(III)},$$

where const. $= 5 \times 10^{-6} \times \sqrt{\eta.\omega/2}$

This relationship has two zero points at $$r_N/(r_G \times z) = 0 \text{ and } r_N/(r_G \times z) = 0.5$$

between which lies the maximum value of the function for $h_{min}$.

If the dimensionless geometric magnitude $r_N/(r_{G+z})$ which defines the profile versus degree cam angle, is denoted the hydrodynamic rating index $\gamma$ and, if the minimum thickness of the lubricant film $h_{min}$ is referred to the optimum value $h_{opt}$ which is at all possible in the critical range $0 < \gamma < 0.5$, then the relative lubricant film thickness is obtained by $\xi$.

$$\xi = \frac{h_{min}}{h_{opt}(0 < \gamma < 0{,}5)} = \sqrt{\frac{12\gamma^2 - \gamma^1}{0{,}125}}$$

For the sake of completeness, the function of the relative lubricant film thickness $\xi$ is also indicated which will be obtained when taking into account the complete formula for calculating the $h_{min}$ value:

$$\xi = \frac{h_{min}}{h_{opt}(0 < \gamma < 0{,}5)} = \frac{1(2\gamma - 1)1^{0.7}.\gamma^{0.43}}{0{,}35038}$$

Figure 2:
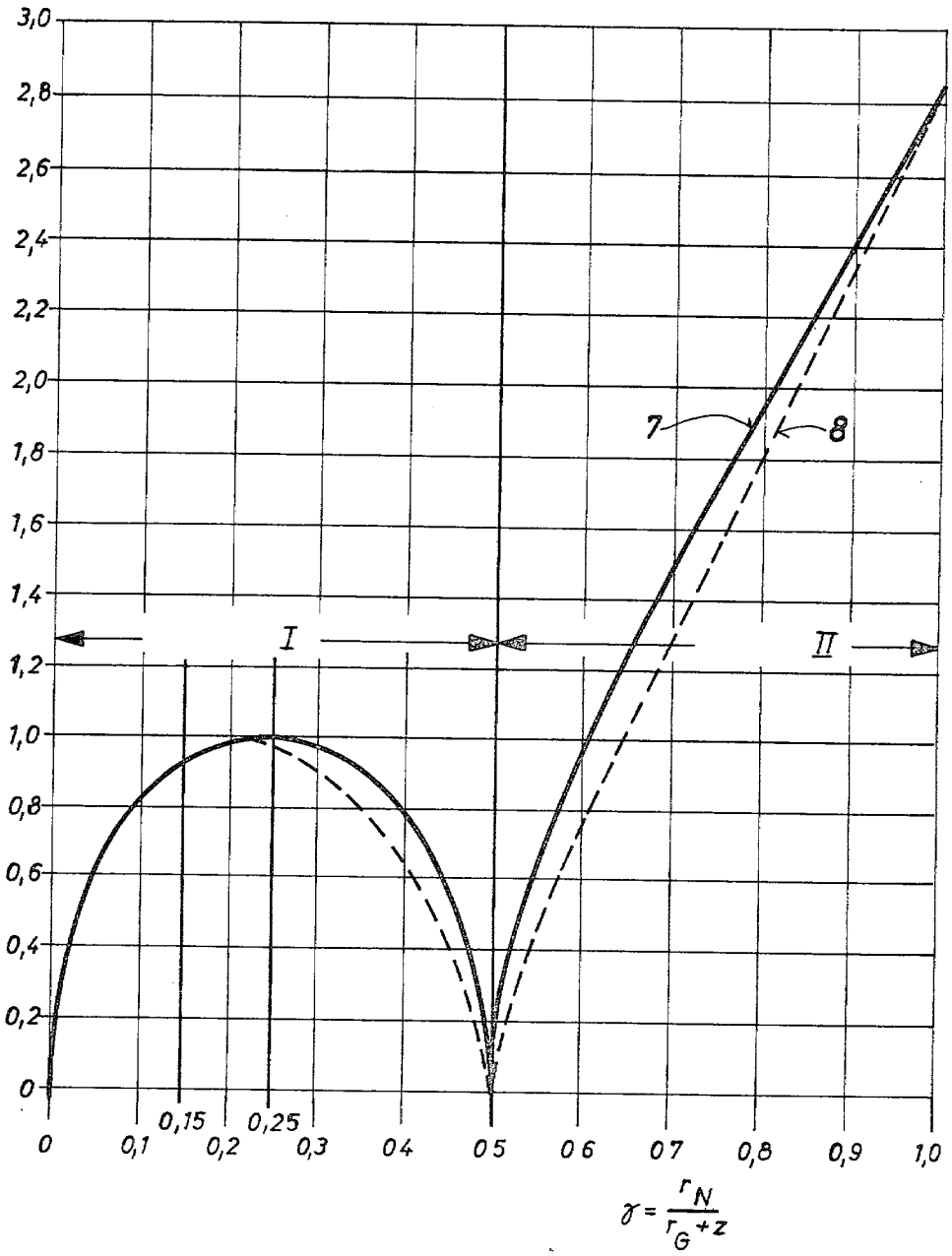
FIG. 2 shows the dependency of the hydrodynamic rating index on the relative lubricant film thickness in the form of a graph.

FIG. 2 shows the relative lubricant film thickness as a function of the hydrodynamic rating index $\gamma$. It follows from the fact that the hydrodynamic rating index $\gamma$ is composed of the geometrical parameters of the cam 1, such as radius of curvature $r_N$, base circle radius $r_G$ and cam lift z of which the cam lift z and radius of curvature $r_N$ will vary due to wear and, consequently, influence the rating index $\gamma$, that the optimum design of a cam profile in the range affected, viz. $0 < \gamma < 0.5$ will be attained only if at the cam nose, the index $\gamma$ comes to lie on the left side of the curve maximum (range I) because any wear occurring with a consequent $\gamma$ shift of the hydrodynamic rating index $\gamma$ in the direction of 0.5 will first cause an improvement and, after the maximum has been exceeded, a deterioration in the formation of a load-carrying lubricant film. In the range $\gamma > 0.5$ (range II), however, wear will produce only advantages in lubricant film formation.

This range is incidentally attained only rarely, for instance in the case of round cams. It should be added that the bold curve 7 has been determined by means of the simplified formula after Dowson and Higginson and the dotted curve 8 according to the complete formula.

We claim:

1. A cam for actuating valves of reciprocating machines in which the valve is opened by a sliding contact flat face cam follower riding on said cam in opposition to the force of a closing spring and which will provide an optimum load carrying lubricating film on the nose of the cam and increase the life of the cam so that it approaches that of a roller comprising a cam body having an outer peripheral cam surface bearing on said flat face of the valve, said cam surface curvature being such that it has a hydrodynamic rating index $\gamma$ in the range $0.15 \leqq \gamma \leqq 0.25$, where said hydronamic rating index is calculated from the formula $r_N/(r_g + Z)$ where $r_N$ is the radius of curvature of the cam; $r_G$ is the base circle radius of the cam and Z is the respective cam lift.

2. A cam for actuating valves of reciprocating machines in which the valve is opened by a sliding contact flat face cam follower riding on said cam in opposition to the force of a closing spring and which will provide an optimum load carrying lubricating film on the nose of the cam and increase the life of the cam so that it approaches that of a roller, comprising a cam body having an annular cam surface with a cam nose whose surface has a curvature such that it has a hydrodynamic rating index $\gamma$ of about $0.15 \leqq \gamma \leqq 0.25$, where said hydrodynamic rating index is calculated from the formula $r_N/(r_G + Z)$ where $r_N$ is the radius of curvature of the cam, $r_G$ is the base circle radius of the cam and Z is the respective cam lift.

* * * * *

UNITED STATES PATENT AND TRADEMARK OFFICE

CERTIFICATE OF CORRECTION

PATENT NO. : 4,270,407

DATED : June 2, 1981

INVENTOR(S) : GERHARD DESCHLER, HANS GEBHARDT and DIETER WITTMANN

It is certified that error appears in the above-identified patent and that said Letters Patent are hereby corrected as shown below:

Claim 1, column 4, line 39, "hydronamic" should be --hydrodynamic--.

Claim 1, column 4, line 40, "$r_g$" should be --$r_G$--.

Signed and Sealed this

*Fifteenth* Day of *September 1981*

[SEAL]

*Attest:*

GERALD J. MOSSINGHOFF

*Attesting Officer*

*Commissioner of Patents and Trademarks*